364-420 SR
3/27/79 XR 4,146,271

United States Patent [19]
Ward et al.

[11] 4,146,271
[45] Mar. 27, 1979

[54] CONTROL OF SELF-ADVANCING MINE ROOF SUPPORTS

[75] Inventors: Richard Ward, Worsley; Kenneth Darbyshire, Wigan, both of England

[73] Assignee: Dobson Park Industries Limited, Lancashire, England

[21] Appl. No.: 826,902

[22] Filed: Aug. 22, 1977

[30] Foreign Application Priority Data

Aug. 20, 1976 [GB] United Kingdom ..... 34693/76

[51] Int. Cl.[2] ..... E21D 15/44
[52] U.S. Cl. ..... 299/1; 364/107; 364/420
[58] Field of Search ..... 299/1, 30, 33; 61/45 D; 364/420

[56] References Cited

U.S. PATENT DOCUMENTS

| | | | |
|---|---|---|---|
| 3,243,964 | 4/1966 | Thomas et al. | 299/1 |
| 3,285,015 | 11/1966 | Carnegie et al. | 61/45 D |
| 3,495,499 | 2/1970 | Ward | 61/45 D |
| 3,531,159 | 9/1970 | Schmidt | 299/1 |
| 3,922,015 | 11/1975 | Poundstone | 299/1 |

*Primary Examiner*—William Pate, III
*Attorney, Agent, or Firm*—William Anthony Drucker

[57] ABSTRACT

Control units at each support have means for receiving function initiating signals from a communication system common to the supports, means responsive to those function initiating signals for issuing corresponding control signals to component elements of the associated support and means for transmitting data to the communication systems. A remote control unit has means for issuing control signals including such function initiating signals over the communication system, means for receiving data from the supports, means for specifying a sequential or automatic mode wherein support advancing means are successively operated sequentially, and means for displaying data from and relating to the supports. Advantageously, the sequential or automatic mode specifying means is operative relative to a preset distance, and the remote control unit further comprises means for specifying selective or manual modes wherein an individual support is selected and controlled without reference to any set sequence, one such selective or manual mode implementing the operation of the support advancing means to a, or said preset distance, and another allowing such operation without preset of its distance.

37 Claims, 4 Drawing Figures

CONTROL OF SELF-ADVANCING MINE ROOF SUPPORTS

The invention relates to the control of self-advancing mine roof supports and has particular reference to automated operation of a row of such supports at a mining face.

In both longwall and shortwall mining systems to which this invention is applicable, successive webs of material, usually of the same predetermined thickness, are taken from the mineral face by a mining machine that is traversable relative thereto along guide means. Material won from the face in this way is carried away between main and tail gates, generally to the main gate, by a face conveyor to which mining machine guide means may be attached. Roof collapse across the length of the face between the gates is guarded against by a row of mine roof support each having a ground-engaging structure, a roof-engaging structure and props acting between them usually by a pressure-fluid medium, together with conveyor advancing and/or support advancing means acting between the supports and an anchorage, therefore, normally the face conveyor itself.

Often, the mining machine will remove a web from the entire height of the mining face in a single traverse thereof. However, more than one traverse may be required and such multiple traversing will normally start at the top of the face height and at its foot, with the possible requirement for progressive extension of beam or canopy elements from the roof engaging structures of the supports proper and behind the mining machine on its first traverse. Whether one or more traverses are required, once the mining machine is traversing and removing the lower part of the face, the mine roof supports are generally required to push over the face conveyor in the wake of the mining machine and draw themselves up to that face conveyor, thereby forming a socalled "snake" of the face conveyor, albeit allowing a minimum head-way of the mining machine relative to the latest roof support to be operated to push over the face conveyor. Such operations require the supports, though not necessarily all of them (often one in four), to be operative while set between floor-and-roof, to push over the face conveyor into the mining face. Afterwards, the roof-engaging structure may be lowered, the support drawn up to the conveyor, and the roof-engaging structure reset against the roof. This latter operation will be performed for all of the supports in sequence. Only one of the supports will, of course, be released from its roof supporting condition for such advance at any one time.

Previous attempts have been made to automate the operation of a row of self-advancing mine roof supports, but have met with difficulties in meeting the very stringent safety regulations that are an essential feature of mining, particularly coal mining. One system of the Applicants has reached the required intrinsic safety standards using discrete component semiconductor technology in conjunction with a tape reader in a control console remote from the row of supports, typically situated in the main gate. Even this system however had a power supply demand that made the achievement of intrinsic safety certification difficult and expensive. It is therefore one object of the invention to provide a system that is better suited to obtaining a low power demand and utilising more recent integrated circuit semiconductor and liquid crystal display developments in electronics. CMOS types are preferred.

At any such mining face, it is important for the supports to be advanced equally so that an initial alignment of them, and the face itself will be maintained as that mining face is driven along the mineral bearing seam with waste material, i.e. non-mineral bearing material cleared from the face, packed behind the row of supports as they advance. It is generally undesirable for the face to bow or for the caving line to curve, in view of the forces involved. It is therefore a further object of the invention to provide a system in which adequate provision is made for controlling roof support alignment.

According to the invention there is provided a control system for a plurality of self-advancing mine-roof supports, the system comprising units, one at each of the supports, and each having means for receiving function initiating signals from a communication system common to the supports, means responsive to those function initiating signals for issuing corresponding control signals to component elements of the associated support and means for transmitting data to the communication system; and a remote control unit for issuing control signals including such function initiating signals over the communication system and for receiving data from the supports, the remote control unit including means for specifying a sequential or automatic mode wherein support advancing means are successively operated sequentially, and means for displaying data from and relating to the supports. Preferably, the sequential or automatic mode specifying means is operative relative to a preset distance, and the remote control unit further comprises means for specifying selective or manual modes wherein an individual support is selected and controlled without reference to any set sequence, one such selective or manual mode implementing the operation of the support advancing means to a, or said preset distance, and another allowing such operation without preset of its distance.

The so-called manual modes may be operative in relation to drawing of the supports up to a face conveyor and/or in relation to pushing of the face conveyor by advancing ram means of the support. The preset distance may be relative to a prescribed extension of the advancing ram means on pushing over of the face conveyor in a snaking operation or, and, as will be specifically described later herein, relative to a prescribed retraction of the advancing rams on advancing of the supports up to the face conveyor that has previously been pushed over by maximum extension of the advancing ram means. It is, of course, feasible for presets to be applied to both ram extension and contraction with neither involving a maximum.

One convenient way of achieving such manual modes of support advance control is for a support unit to cause latching of a solenoid valve controlling pressurisation of the advancing ram means until a preset advance is achieved in the first manual mode, latching preferably being hydraulic and on push only, and to be directly controlled without latching in the second manual mode. Such modes will be referred to herein as latched and unlatched manual modes and the latching may be hydraulic or electronic or both, say hydraulic for a maximum extension or contraction and electronic for a preset relative thereto.

A preferred system implementation is based on digital data processing techniques and utilises a programmed, word organised, parallel operating computer system, preferably CMOS, for the remote control unit to issue sequences of instructions required for the desired modes of operation; standard support units, one for each support, that are uniquely addressable by the control unit and serve to translate instructions in the form of multi-bit binary words into specific enabling signals; and a communication system utilising serial transmission techniques with parallel-to-serial conversion at output from the control unit and serial-to-parallel conversion at input to each support unit, preferably with parity checking. Such a system requires only one conductor core for transmission of instructions. Preferably one core is used for each direction of transmission plus a common core.

It is, however, preferred to have a multi-core interconnection of the support units and the remote control unit so that suitable power supplies can be located at the remote unit with two conductor cores reserved for taking appropriate voltage levels to each of the support units. Conveniently, two power supplies may be used, one for the support units and the other for the remote control unit. A back up battery rechargeable from one or either such power supply may be provided to ensure that information in volatile semiconductor type storage means is maintained for at least a minimum period after failure of the or each power unit.

It is, of course, desirable for the remote control unit to be able to indicate the states of selected support units, say in relation to whether the roof supporting props are properly set against the roof or have an extension so short as to be about to go solid, achievement of preset ram extension, etc, and provision is preferred for transmission of data relating to at least advancing ram stroke an extension or contraction to be transmitted to the remote control unit.

A particular cumulative type alignment provision specifically referred to herein requires data representing actual ram extension or contraction, rather than errors from a preset value, to be transmitted from the support units to the remote control unit and to be totalled cumulatively at the control unit for display when required. It would, of course, be possible at display time for the cumulative totals to be offset either relative to one such total, say the highest or lowest, or to a nominal predetermined value. However, it is preferred herein to display cumulative totals and to use a single numerical display for both actual ram extension or contraction during operation of each support and cumulative sum display by having a change of scale for these two displays.

It is feasible for transmission from the support units to the remote control unit to take place over the same conductor core as used for transmission in the opposite direction, but it is preferred to reserve a further separate conductor core for this purpose.

Two further cores of a communication cable are preferably reserved for the transmission of clock pulses and control of an audible indicator at each support unit intended to warn that operation thereof is imminent and/or in progress. Further cores could be used for warning signals, or audio communication from the support unit to the remote control unit, or for an emergency stop signal.

The remote control unit preferably has a further mode of automatic operation in which the support units are sequentially addressed, instructed to transmit their states, and those states then checked against presets at the remote control unit (or against zero if offsets only are transmitted, say for advance ram stroke). Departures from desired states may cause this mode to stop with display of the support address concerned and the incorrect state or states concerned. This may be remedied by manual operation or the condition noted and the remote control unit overriden to continue the monitoring mode. It is preferred that this monitoring mode of operation should automatically precede each automatic advance of the row of supports as a whole.

Another preferred feature is for manual interruption of an automatic mode to be succeeded by an automatic return to stored information so that the automatic mode will be resumed at the point at which it was interrupted.

It is further preferred that the remote control unit have provision for receiving input signals representing the position of the mining machine at any moment which, together with information regarding the position of advanced chocks, allows interlocking of automatic operation so that a minimum headway of the mining machine over the snake formation in the face conveyor and its guide means is maintained.

A preferred emergency stop facility has a line traversing at least selected, and preferably all, support units, such line being in a circuit interruptible at anyone of those support units and associated means for detecting such interruption and operating a control circuit accordingly at the remote control unit. Preferably, an interrupt is also provided at the remote control unit in the same line. Separate means may advantageously be provided for detecting short-circuiting of the emergency stop line.

The first means for detecting may be connected in series with the emergency stop line with the further means connected in parallel with the first.

Both of the means for detecting, conveniently electrooptic isolators, are preferably connected in series in a control path for the control circuit including a monostable device, which, is conveniently implemented by way of a relay, preferably having a volt-free contact for intrinsic safety requirements, with a hold circuit including the control path and regulated to require shorting out of the regulator in order to reset the control circuit after emergency stop operation regardless of whether the means for detecting ceases to detect an interruption and/or short of the emergency stop line.

One specific implementation of the invention will now be described, by way of example, with reference to the accompanying drawings in which.

Figure 1:
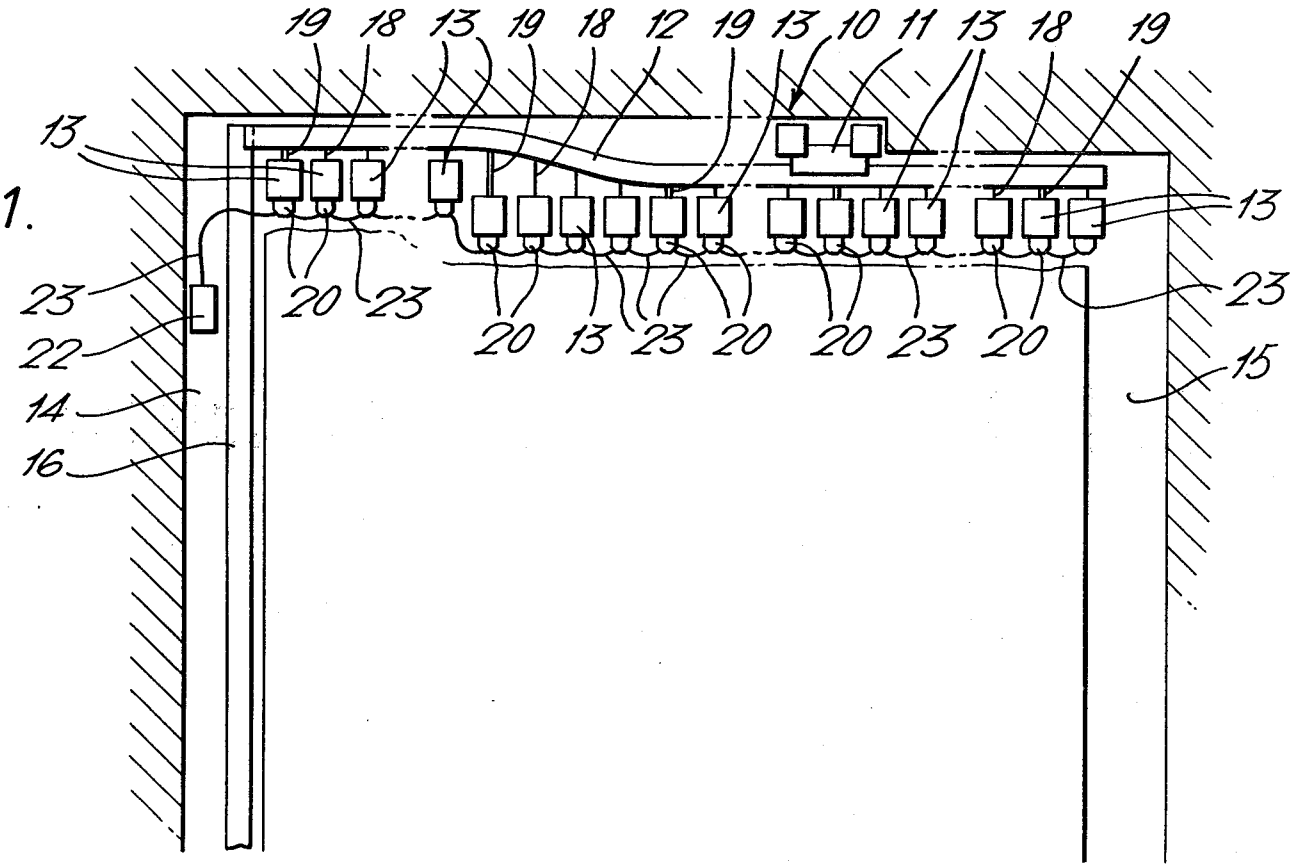
FIG. 1 is a block diagram of part of a longwall mine face working with individual support units and a remote control unit indicated diagrammatically together with its intercommunications.

In FIG. 1 a longwall mineral face 10 is shown being traversed by a mining machine 11 on guide means integral with a face conveyor 12. The mining machine 11 is assumed, at least for the purpose of the immediately following description to cut the full face height on traversing in one direction and is shown part way through a cutting traverse from left to right of the drawing with the face conveyor being progressively advanced behind it in a "snaking" operation, and serving to transfer material from right to left of the drawing.

A row of self-advancing mine roof supports 13, not shown in detail, extends between main and tail gates 14 and 15 normally used for mineral removal via conveyor 16 and supply purposes respectively. Each support will have a ground-engaging structure and a roof-engaging structure with pressure-fluid-operated props acting between them to set the roof-engaging structures against the roof in its supporting state and to lower such a roof-engaging structure for advance of the support. The supports are coupled to the face conveyor by pressure-fluid-operated ram means 18 shown as double lines 19 for every fourth support to indicate that only those supports are involved in pushing the conveyor to the mineral face, whereas each of the other ram means will be used for advancing the corresponding support up to the conveyor after release of that support from the roof. The use of the double lines may indicate separate rams for conveyor advancing and support advancing, or, and preferably, a double-acting ram to serve both purposes.

Each of the supports is controlled by way of its own locally mounted unit 20 from a remote control unit 22 via an intercommunication system utilising a multi-core cable 23. The remote control unit 22 is shown as being positioned in the main gate 14 used to take mineral bearing material away from the face but could equally well be positioned elsewhere, for example in the tail gate 15.

Figure 2:
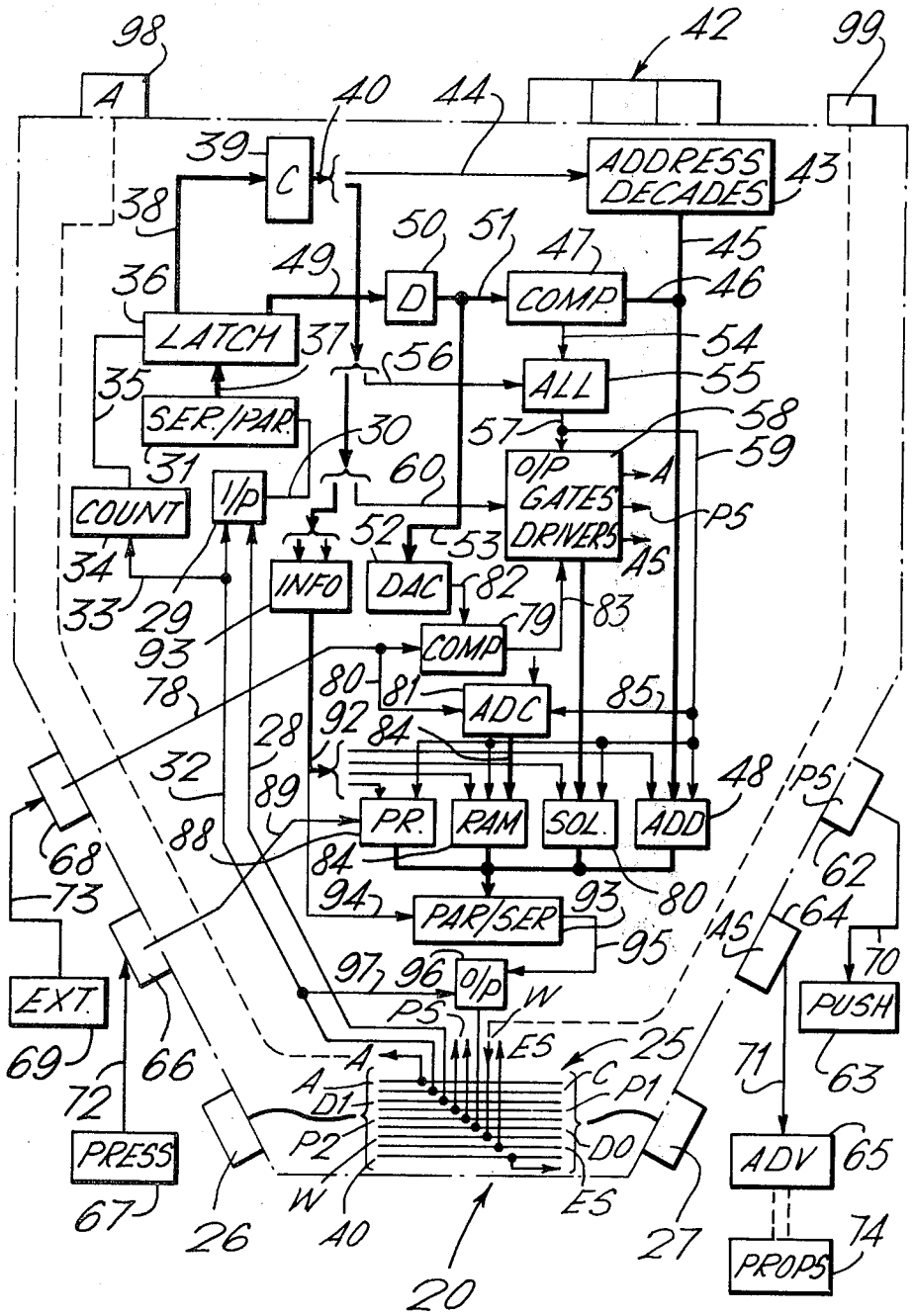
FIG. 2 is a block circuit diagram of a support unit.

Individual cores of the multi-core cable 23 are indicated and identified at 25 in FIG. 2 in relation to exemplifying a junction box or equivalent arrangement in relation to a direct interconnection between two cable sockets 26 and 27 in a casing of the unit 20. The identifying references carried by these individual cores are as follows DI and DO indicate lines reserved for transmission from the console to the support units and from the support unit to the control console, respectively; P1 and P2 indicate different levels of power supplies for logic circuits within the support unit 20; though one 12 volt line regulated down for logic drive to 5 volts at each support unit may be preferred; C indicates a line reserved for clock pulses; A and W represent audio lines for communication from the console to the support unit and from the support unit to the console, respectively; AO represents a common audio line; and ES represents an emergency stop line.

The input data line DI is shown connected via line 28, clocked input buffer stage 29, and line 30 to a serial-to-parallel converter 31. Clocking of the input buffer stage 29 is by clock pulses taken via line 32. Serial transmission techniques are used for transmission of control and data words of a predetermined bit length, specifically eight bits. The clock pulse line 32 is shown branched at 33 to a counter 34 having an output 35 that is energised on every eighth clock pulse as would occur for an overflow output of a counter with a capacity of eight, or a divide by eight circuit. The control output on line 35 is applied to a set of latches, 36, one for each of outputs 37 from the serial-to-parallel converter 31. This arrangement serves to produce parallel eight bit binary words from the serially occuring bits on the input DI.

The particular preferred format of control and data words from the control console is where each input eight-bit word has four bits reserved for control purposes and four bits reserved for data purposes. Such an arrangement allows sixteen different control signals or orders as will be specified later herein following further description of the component parts of the support unit 20 of FIG. 2. The relevant four outputs 38 of the latch arrangement 36 are shown applied to a decoder 39, which could take the form of a binary to one-out-of sixteen converter 39, having outputs 40 for controlling various operations of the support unit 20.

Each of the support units 20 has an address by which it is identifiable, which address takes the form of a number in a sequence of numbers preferably identifying the support units in order from one end of the face. For address setting in decimal digits a group of three manually preset switches is indicated at 42, which may be thumbwheel or otherwise operated. Each such switch is equipped with a binary decoder to give a four-digit binary number corresponding to its decimal digit setting. A three-word capacity register or store is indicated at 43 for holding binary representations of the preset states of the binary coded decimal outputs of the switches 42. This store 43 is shown as having decade select lines 44 from the outputs 40 of decoder 39. On the basis of a binary to one-out-of-sixteen decoder 39, there will be three such lines 34, one for the four bit number of each decade, though a different form of decoder could provide for two-line selection according to binary values. The store 43 has a fout-bit wide output 45 shown branched at 46 to a comparator 47, and also feeding and address output register or latch 48.

That half of an input word in the latching arrangement 36 corresponding to data is shown applied over lines 49 to a data register 50 that is four bits wide and has outputs to the comparator 47 over lines 51 and to a digital-to-alalogue converter 52 over branch lines 53 for purposes to be described.

When a particular support unit is selected a succession of eight-bit-binary words are transmitted in serial form corresponding to the three required decoder of address comparison. These words will be received in sequence at the serial-to-parallel converters 31 of each of the support units 20 and the appropriate decimal digit representations will go in turn to the data register 50. Each of the corresponding four-bit order word parts is decoded in turn to energise the lines 44 appropriately to select the decade concerned. The comparator 37 is shown with a match indicating output 54 applied to a circuit 55 for indicating whether three successive match signals are received over the line 54 on any address comparison operation. The circuit 55 may be embodied in any convenient way, for example a two-stage counter with coincidence gating of its outputs to recognise the desired condition, or shift register with appropriate gating to accept the states of lines 54 in successive stages and coincidence gating of its outputs, or a shift register or ring counter gated by outputs on the line 54, or other logic circuit means. For convenience the circuit 55 is assumed to require resetting at the start of an address comparison sequence and/or to require sampling at the end of such sequence and a control line 56 from the order decoder outputs 40 is shown applied thereto.

It is noted that until any particular support unit is selected, i.e. a complete match is achieved for all three of its decades as indicated by output 57 of the circuit 55, it is only necessary for the address comparison circuitry of each support unit 20 to be powered. Address match output 57 is therefore shown as applied to enable output gate and driver power supply control circuitry 58 and is branched at 59 to cause up-dating of information output registers or latches of which that relating to address information is shown at 48. Lines 60 are shown applied to the circuit 58 from the outputs 40 of the order decoder 39 in order to serve for powering and enabling output gates and/or local unit drivers such as conveyor advancing ram control solenoid means as will now be described.

Each support unit 20 is indicated as having connection points 62 for energising a conveyor advancing ram solenoid 63 to push the conveyor forwards into the face, 64 for energising a solenoid 65 for controlling a conveyor advancing ram to draw the support up to the face conveyor, 66 for receiving a signal from a pressure detector 67 for roof supporting props of the support, and 68 for receiving a signal from a conveyor advancing ram extension transducer 69. These connection points 62, 64, 66 and 68 are advantageously of socket form to cooperate with suitable plugs for cables 70, 71, 72 and 73 by which connection is made to the solenoids 63 and 65, the pressure sensing device 67 and the ram extension transducer 69, respectively. The solenoids 63 and 65 may, of course, be combined in a single unit and it is assumed that suitable hydraulic, electromagnetic or other interlocking and automatic sequencing is provided in relation to the action of the solenoid 65 and roof-support props indicated generally at 74 so that the latter are released prior to advancing the support and reset against the roof following such advance. The solenoids 63 and 65, the pressure switch 67 and the ram extension transducer 69 will normally receive electrical power for operation and/or interrogation purposes only when the circuitry 58 is appropriately enabled.

The extension transducer 69 may take any convenient form, such as a potentiometer or an ultrasonic detector. It is, however, assumed that the output from the extension transducer 69 will be in analogue form, though, as will be mentioned later, a digital or pulsed signal could equally well be used. A ram extension signal of analogue form is shown taken via line 78 to an alalogue comparator circuit 79 and branched at 80 to an analogue-to-digital converter 81. The comparator 79 is shown as being supplied at its other input over line 82 from the digital-to-analogue converter 52 so that a prescribed advance can be specified by the control console over lines 53 with the comparator output fed via line 83 to the driver control circuitry 58 to disable further advance operation once that prescribed extension is achieved.

The analogue-to-digital converter 81 has its outputs 84 applied to a ram extension register or latch 85 and is enabled to up-date the latter over a branch 85 from the address confirmation line 59. Another branch 86 from this line 59 is shown as enabling up-dating of a prop pressure confirmation register or latch 88 fed via line 89 with the pressure sensor signal, and also updating of a solenoid statue register or latch 90 which is shown fed with information from the output or driver control circuitry 58.

It would, of course, be possible to use a digital comparator instead of the analogue comparator 79 in which case the digital-to-analogue converter 52 would not be required and total advance data would be available from the analogue to digital converter 81. However, this could be dispensed with if the converter 52 is retained together with the analogue comparator and output from the latter applied to subtractor means fed by the lines 53.

Selection of a desired one to the output registers or latches, 48, 84, 88 and 90 is achieved over lines 92 from an information control latch 93 on relevant ones of the order decoder outputs 30. Outputs from the information latches are connected in common to a parallel-to-serial converter 93 also enabled by a control line 94 from the order decoder outputs so as to supply, over line 95, an output buffer stage 96 that is clocked from branch 97 of the clock line 32.

The support unit 20 is also shown as including an audio speaker or buzzer 98 by which an audible signal is produced preparatory to any operation of the associated support, and a warning signal input 99 which may be used for audio transmission from a particular support to the remote control console.

Figure 3:
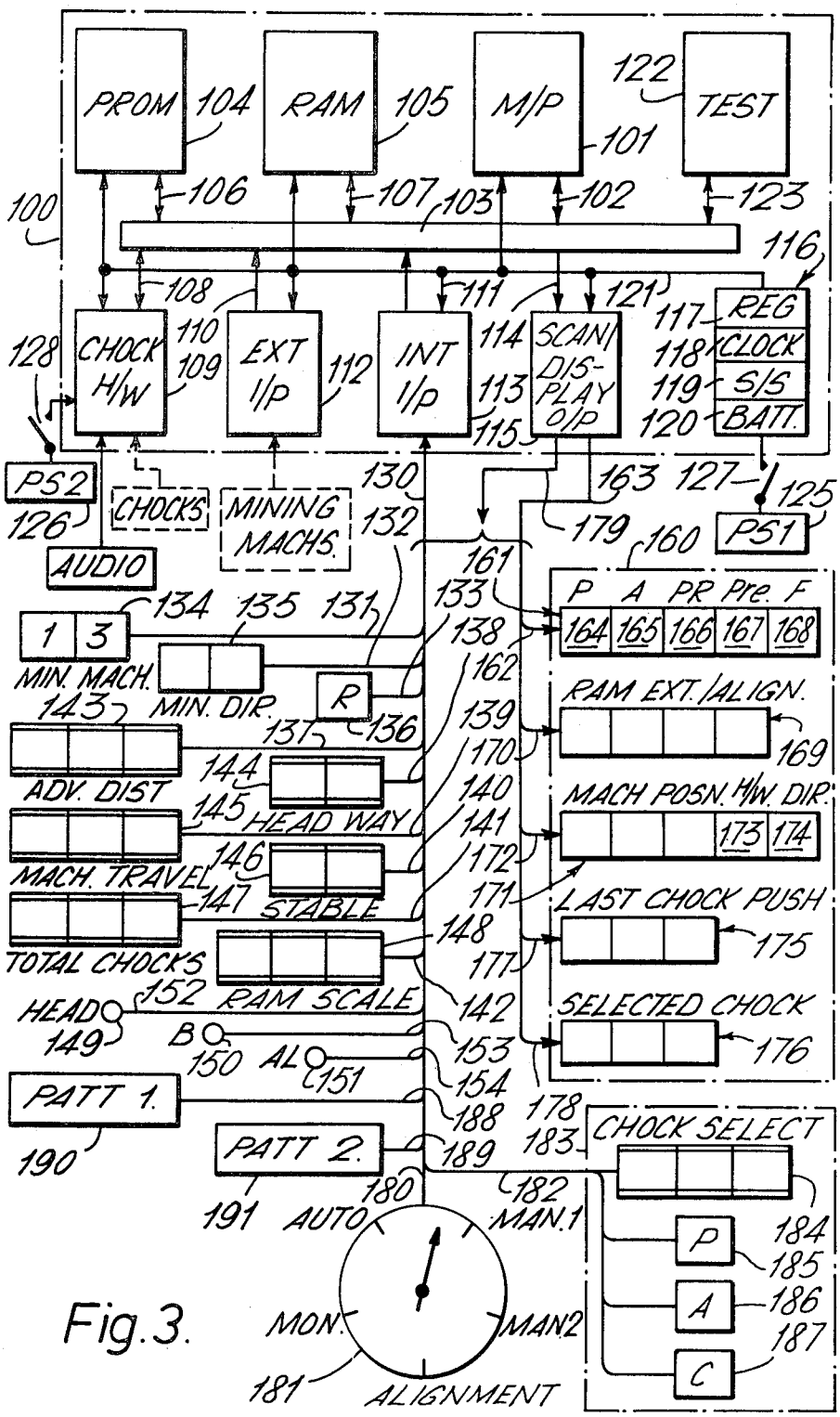
FIG. 3 is a block diagram of the remote control unit.

In the specific implementation of a remote control facility shown in block diagram form in FIG. 3, basic control is afforded by a programmed minicomputer 100 composed of several basic modules that could very well be varied for other specific implementations. In FIG. 3, however, a microprocessor module 101 is shown intercoupled at 102 to an internal computer highway 103. The highway 102 is also coupled to memory facilities that are specifically, a programmed ready-only memory (PROM) module 104 for storing programs, and a volatile read/write memory (RAM) module 105 for storing variable parameters or intermediate data processing results. Two-way parallel couplings 106 and 107 to the highway 103 are shown for the memory modules 104 and 105, respectively, to indicate provision for memory addressing and data and program word recovering from particular addresses. Each of these modules preferably uses semi-conducter integrated circuits affording parallel binary data processing of convenient word width, bearing in mind the requirement to supply 8-bit wide words to the support units. A suitable maximum word width could be 16 bits, though 12 bit wide processing could be equally suitable.

In general, it has been found convenient to have to PROM modules, one for basic program routines and the other for specific face program material appropriate to a particular installation. In practice such modules will have consecutive addresses and will thus appear as contiguous storage to the microprocessor, in other words, as though they were a single module. This is, of course, not to imply that the RAM module is distinguishable to the microprocessor except by the values ascribed to its addresses within the overall memory arrangement.

The computer 100 is also shown as including two-way parallel couplings from highway 103, namely coupling 108 to a support unit highway input/output module 109, couplings 110 and 111 to external and internal input modules 112 and 113, respectively, and coupling 114 to a scanning and display driver output module 115. A regulating and generator module 116 including logic level regulator circuitry 117, clock generator circuitry 118, start-up and shut-down control circuitry 119, and stand-by battery charging circuitry 120 is also shown coupled to all of the foregoing modules over coupling system 121.

A test and bootstrap facility is indicated by module 122 also coupled at 123 to the computer highway 103. This latter module 122, of course, allows testing in manufacture, during commissioning, and for maintenance and fault finding in the usual way, and preferably allows a serial based manual control over operation of the computer as well as providing for accessing and display of the contents of individual memory locations and microprocessor registers. The bootstrap facility enables new programs to be entered into the RAM memory part for testing before being permanently entered into a PROM module.

The chock highway interface module 109 will include serial-to-parallel and parallel-to-serial conversion circuitry in order to prepare incoming serial data from the support units for parallel transmission over the computer highway 103 and to serialize outgoing instruction and data words for the support units. Two separate power supplies are shown at 125 and 126 for, respectively, the computer system proper and the support unit highway and support units, with the computer power supply 125 only shown as being utilised for charging the stand-by battery, though provision could be made for additional or alternative charging from the other power supply 126 which, if desired or required, could also be subjected to regulation, possibly by or at least sharing the regulation circuitry 117 of the module 114. On-off switches 127 and 128 are also shown, purely diagrammatically, for start-up and shut-down of the computer and chock highway systems. These too, may, in practice, be within or at least controlled by the circuitry 119 of the module 114. The power supplies may be of different voltage levels, particularly as long cable runs occur to support units so that regulation of a 12 volt line at those units is generally preferred.

Separate modules 112 and 113 are shown for external and internal inputs for reasons of intrinsic safety as required in coal-mining systems. The term internal inputs is intended to mean lines feeding in presets, etc at the central control console itself.

External inputs refer to lines from outside the computer and support unit system proper, specifically from one or more mining machines in operation on a face to which the controlled supports relate. Such information is required in order to determine whether there is enough headway for supports to continue advancing, i.e. whether the mining machine of interest is at least a minimum distance in advance of the support to be advanced. In one preferred implementation, there are three mining machines on a face with the module 112 normally operative to receive information from the middle machine, but also selectively operable, as will be described, to select for information from either of the other machines. The external input module will normally contain for each mining machine as many inputs, say, 8 as are necessary to define in binary code the maximum length of the face to the desired accuracy, say in units of the pitch of a mining machine self-propulsion mechanism, and such individual input circuitry will be powered from the mining machine control system. However, these inputs will be isolated from the computer system, say by electro-optic isolation circuits for each machine input and a corresponding computer system signal generator circuit of the module 112.

Isolated input circuitry of the type just referred to in relation to the module 112 is expensive and it is an important advantage of the system being described that the need for such circuitry is reduced to a minimum as all remaining inputs are via the module 113, the support units, and the support unit highway, and are realisable in a homogeneous semiconductor type technology utilising active integrated circuits based on transistor and diode elements where there is no danger of generating localised high temperatures, as at hot spots or by spark action, particularly in view of the low voltages required for operation of such integrated logic circuits on circuit boards preferably interconnected by a "mother board — daughter boards" type of structure.

The internal input module 113 is shown with input lines 130 from various control console input means such as push buttons, thumbwheels and switches. Specifically, push-button input lines 131, 132 and 133 are shown from a double unit 134 serving for alternative selection of the above-mentioned other two mining machines for supply of information to the computer highway 102 from the external input module 112, from a double unit 135 serving for setting either of two possible directions of mining along the face concerned and between the main and tail gates, and from a single unit 136 serving to reset the system after operation of an emergency stop facility referred to above in relation to FIG. 2, respectively.

Thumbwheel input lines 137 to 142 are also shown. These lines 137 to 142 serve for supply information from units as follows, and taken in order. A three-decade thumbwheel operated input unit 143 supplies information concerning the desired advance distance for the supports of the face. A two decade unit 144 supplies information concerning the minimum headway required of a mining machine before a particular support can push over the conveyor and be itself advanced. A three decade unit 145 supplies information concerning the total allowed travel for the mining machine along the face. A two decade unit 146 supplies information concerning the extent of face end accommodation, or "stable", for a mining machine at the end of its cutting i.e. into a heading previously cut into each end of the face from the tail and main gates to define the mineral working face length. A three-decade unit 147 supplies information defining the total number of chocks or supports on the face, and another three-decade unit 148 supplies ram scaling information concerning a full scale for the chock extension ram analogue input, normally the middle 60% of a potentiometer type ram extension transducer.

Each decade of the thumbwheel units will normally include a binary code output means and may be separately connected by individual ones of lines 137 to 142, or a single binary code output means for a decade may be associated with each unit with gating thereto from the individual thumbwheel decades controlled by scanner selection as desired and as will be better understood following description of the module 115. Four input lines 130 will be adequate for each decade and it has been found to be generally satisfactory for eight outputs from the module 113 to be fed from eight inputs thereto (the lines 130) that are shared by the various thumbwheel and other inputs on a selection basis with two cycles of scanning being required for the three-decade units. It would, of course, be equally practicable for at least twelve input lines 130 to be used with unit selection as appropriate and scanning as required within the unit 113, and other schemes can be devised, say in extremis, where all scanning is within the unit 113 and each unit has its own inputs 130 thereto, though that is considered undesirably wasteful on wiring.

The individual switch units are referenced 149, 150 and 151 and supply lines 152, 153 and 154, respectively. Switch unit 149 serves to indicate that the requirement of a minimum headway is to be overridden. Switch unit 150 allows isolation of the stand-by battery from the power supply and switch unit 151 serves to indicate that readout is required for checking face alignment as will be described.

It is to be understood that the references to push buttons, thumbwheels and switches represent only a preferred arrangement and any convenient and suitable means may be used for input and presetting purposes as desired.

The remote control console also includes display devices that are preferably embodified as liquid crystal displays so as to be driven directly at logic levels and represent a further homogeneity of technology within the control unit. The display devices are indicated within the chain-dash box 160 as including a first bank of decimal digit displays 161 fed over a branch 162 from output lines 163 from the scane and display module 115. The bank 161 includes separate display units for individual selected roof supports, specifically at 164 for indicating whether or not the support is pushing the face conveyor over, say by the presence or absence of the letter P. Unit 165 will serve to indicate whether or not the selective support is advancing up to the face conveyor say by the presence or absence of the letter A. Unit 166 will indicate whether or not the selected support has its support props at a desired minimum pressure for roof support purposes, say by the presence or absence of the letter H. Unit 167 will indicate whether a prestart warning audible signal is being transmitted and unit 168 will indicate the presence of a fault and, as will be described, preferably takes the form of one of a series of numbers indicating the type of fault concerned.

Another bank of four display units 169 is indicated as being fed from the display module output 163 over branch 170. This bank of display units is intended for a dual purpose in that normally it will represent in numerical form the actual ram extension of the selected support, but on operation of the switch 151 will serve to display accumulation of advances of that roof support since the face was last surveyed and/or corrected in relation to possible alignment errors.

A five unit display bank 171 is shown fed over branches 172 from the display module outputs 173 and serves to display information relating to the mining machine, normally the middle one of three machines on a face but, on operation of the push button unit 134 either of the other mining machines. The left most three units are for the mining machine position along the face, unit 173 is to indicate whether or not there is sufficient headway for the selected support to be caused to push over the face conveyor, say by the presence or absence of the letter C, and the rightmost unit 174 is to indicate the direction of mining operations along the face as set by the push button unit 175, say by the number 1 or 2.

Two further three unit display banks 175 and 176 are shown fed over branches 177 and 178, respectively, from the scanning and display module output 163. These banks 175 and 176 serve to display the identity of the last roof support to have pushed over the face conveyor so that headway information can be checked and to indicate the identity of the currently selected support, respectively.

The scanning and display module 115 is also shown as having outputs 179 by means of which the states of individual ones of the input units and individual ones of the display units or banks are selected to transmit their contents over lines 130 or receive drive information signals over lines 163. The liquid crystals display units preferably include individual binary to alpha numeric decoding circuitry were required, though for particular ones of the units such as 164, 165, 166 and 167 and 173 a simple on-off type enablement may be used.

The internal input lines 130 are also shown as being connected at 180 to a master mode selector allowing the selection of automatic, monitor, latched manual, unlatched manual and face alignment operation. These internal input lines 130 are also shown at 182 as being supplied for manual modes of operation from units within a chain-dashed box 183. Specifically these manual mode facilities include a three decade thumbwheel unit 184 for roof support selection, a push button 185 for initiating a latch manual mode conveyor push over operation or controlling the duration of such an operation in the unlatched manual mode. A push button 186 serves to initiate advance of the roof support up to the face conveyor, and push button 187 serves to call for a response from the individual selected support, say for communications concerning its state.

The internal input lines 130 are also shown branched at 188 and 189 to banks 190 and 191, respectively, of switches or other presetting devices for defining patterns of roof supports where different types are used, for example master supports that are capable of pushing over the face conveyor as well as drawing the support up to that conveyor, slave supports that are operated at least for advance purposes by the same common master support in banked control operations, and roof supports that are capable of advancing up to the face conveyor but not of pushing it over.

It will be realised that the remote control unit operates by way of a suite of interrated programs involving routines or subroutines in predetermined sequences and with appropriate branches between such routines and sequences. The subroutines will, of course, control data processing actions such as data preparation, instruction despatch to the support units, tests and so on.

Specifically, an address routine will require the sending to all chocks of the hundreds, tens and units for the then selected chock, as part of the automatic a draining, or automatic or selective support unit state monitoring, or either of the manual routines. Following a clear signal for all unselected support units, the return of the address of an uncleared support unit will be required for checking that the correct support unit has been selected. If a match is found, the current support unit address display 176 will be appropriately operated and the fault display 168 cleared unless it indicates, say by decimal 1 or 2, an emergency stop requirement or a support unit solenoid fault, otherwise a fault condition will be indicated, say by display of the decimal number 6 in the unit 168.

A controlling factor at least on automatic advance is the mining machine headway and a routine is required to obtain this information. Basically, operation is assumed to be with reference to a single mining machine or the middle one of three machines. The machine position is first calculated from an input showing its total travel and a preset for the stable end length by subtraction. This is then compared with the address of the last support unit that was last operated to push over the conveyor and the preset headway requirement and the headway clear display 173 set to 'C' if the preset requirement is met or the mining machine is in the stable end. However, if either of the other machines is selected at 134, the routine will go on to calculate the position of that machine and cause it to be displayed. It is also convenient for the same routine to include a further step testing for the selected direction of mining and make the appropriate display at 131. Generally, however, if the middle machine has the preset headway, the automatic advance sequence will be entered if selected. Clearly this latter could be made dependent on the position of either of the other machines, if desired.

Returning now to the actual support unit instructing, a push routine, for pushing the face conveyor over towards the face, will require a test of whether the props of the selected support unit are set between floor and roof of the face working and, if so, the prop pressure display 166 will be set to H otherwise the fault display will be set, say with the numeral 3. If the prop pressure is high, the fault display is cleared and the support unit instructed to operate its audible alarm. A test is made to see if that alarm is operating, if not, the fault display is appropriately set, say with the numeral 5, otherwise, preferably following a delay, the push instruction is issued for support solenoid controlled action to extend the pusher ram. The push display 164 will be energised and following a prescribed delay adequate for support response in extending its pusher ram, the push instruction will be terminated, the alarm instruction cancelled and the prop pressure display reset.

Continuing the actual support unit instructing, an advance routine, for advancing the selected support unit to the face conveyor, will require the selected support unit to return its ram extension value and will display that value at 169. A test of prop pressure to ensure that the support is properly set between the roof and floor will result in a fault display, say numeral 4 at 168, or a clearing of the fault display, setting of the prop pressure display 166 to H and instructing audio alarm at the support unit. The support unit return will be tested for the audio alarm and, if it is not working will set the fault display 168 say with the numeral 5, otherwise a predetermined delay will ensue with the alarm operating, followed by issuing an advance instruction to the support and setting of the advance display 165 to A. The props should automatically release followed by retraction of the conveyor pushing ram and resetting of the props under solenoid control at the support unit. The control unit will sense the low prop pressure and when it is found will reset the pressure display 166 and provide temporary storage for the ram extension value, and will test for this to reach its limit or desired preset value, or a prescribed proportion of that limit and will wait at least a predetermined time for that to occur. Preferably, after a further delay, the advance command will be cancelled followed by cancelling the alarm and resetting the advance delay. As soon as the high prop pressure condition is detected, the display 166 will be set to H and a test made of whether that support is to be used for face alignment checking purposes. If it is, the difference between the initial and final ram extensions will be calculated and added to the cumulative total for that support.

The push routine is conveniently augmented by a dwell routine which is, of course, also applicable to correction operation in general. Such a routine will obtain and display the ram extension value, test for prop pressure, set appropriate displays, issue alarm and push instructions, delay for a preset time, and then reset the alarm and push instructions and cancel displays.

A monitor routine is also required for information gathering from the support units in succession will be arranged to test for operation of the start control, address the first support unit, test for prop pressure and ram extension, displaying the support address, prop pressure state and/or ram extension if not high or at its limit and stop or continue if that is required, increment the support address and repeat the tests for each support in turn until the support address equals the total number of supports on the face.

A preferred full automatic program will test for whether it is specified and, if it is, execute the monitor routine followed by a issuing a pre-start alarm signal before entering push advance and dwell routines for the supports in succession with branches for any fault condition to stop the sequence unless the override or continue push buttons have been pressed when it will reissue the pre-start warning and return to the sequence at the next support address.

Routines are also provided for the two manual modes of operation, namely latched and unlatched. For the latched mode, the control unit will read the selected chock address from the thumbwheels 184, address the selected chock as above, gather its ram extension value and display it. If the "push" button has been operated a dwell routine will be executed. Preferably, this routine is extended to apply also to an advance routine by testing for whether the "push" button has been pressed and, if not, testing for whether the advance button has been pressed, proceeding to the above described advance routine if it has been and returning to the "push" button test if not.

The unlatched push routine will begin as for the latched mode up to the "push" test. If that button has been pressed the prop pressure tests and display and fault displays and alarm instructions will be executed followed by issue of the push instruction. A first test of whether the desired or prescribed conditions of ram extension are met followed by resetting if they are. Otherwise, a test of the "push" button state followed by the ram extension test will continue until either the ram extension criteria are met or the "push" button is released. In the latter case an advance routine may be entered, though testing may be required to make sure that it is safe to release prop pressure, say to ensure that props are never released at the same time on adjacent roof supports.

One other routine is required and that is a response to the requirement for a face alignment readout.

It is also desirable to provide for format control of the system so that the system can operate either by reference to a prescribed bank support arrangement or by way of single support control. It is convenient to define conveyor pushing supports as master (M) with intervening non-pushing supports (N) i.e. advance only, for single support control, and bank operated non-pushing supports as slaves (S). A slave support will not need a support unit as it will be operated directly by and usually in synchronism with a master support, but its address will be needed in order to calculate mining machine headway. It will also be desirable to specify that a master support is a master only for one direction of mining, say using the references M1 and M2. It has been found to be satisfactory to allow a maximum pattern of eight supports and it is possible to mix both single chock control and bank control, and this facility will normally be needed in relation to applying single chock control for the end most support or supports of a bank operating system and will usually apply to 2 to 8 end most supports. The pattern of masters, non-pushers, and slaves will repeat for every eight supports, or fewer as specified in the input requirements at 190.

A further selection can be made as to the pattern of operations, specifically push, advance and dwell routines. For example, using a format of masters separated by four non-pusher supports in single support control, a typical pattern would require a push on the master support addresses away from the last master, dwells on the second and first master supports, advance on the first master and sequential advancement of the intervening non-pusher supports.

Many modifications and variations can be made to the above-described system. For example, it will normally be the case that the emergency stop facility will operate as an override on the entire system operation. Also, it may often be preferred for a face to be operated with only two mining machines, one for cutting a stable-end and the other for main cutting of the mineral face with the control unit normally responsive to the latter.

It may be preferred to make the unlatched manual mode operate as a repeated program loop through the latched mode routine until satisfaction of desired advance is achieved or even to provide for that to be the normal unlatched mode with a further option available of operation as above described, or vise versa. The above-mentioned undesirability of having two adjacent supports release prop pressure simultaneously may also be incorporated as a general check on the state of adjacent supports at least on manual mode selection.

On particularly useful check facility that is desirably incorporated is to have the remote control unit microcomputer system use a "dummy" support for checking exercises. This "dummy" support may be entirely a soft ware, i.e. program-originated, device using predetermined ram extension and/or other prescribed data essentially designed as complimentary data ensuring that each digit position is checked for both possible binary values and correctness of operation in response thereto. For complimentary ram extension readings, the "dummy" support can be made to simulate any particular selected support and so enable identification of the faulty support, if any. This facility is particularly valuable when used with a central control unit check, typically in the form of a comparison of the actual number of PROM or other memory words in store at any one time with the number known to be expected at that time. A single numerical fault display could be provided for fault identification by value and might even be incorporated as further integers in the above-mentioned fault display.

The described system has a high degree of flexibility in that variations to cope with different mining conditions or requirements are readily made by program changes. This also applies to the provision of additional or new facilities on an existing installation. In particular, it will be appreciated that further facilities may be incorporated as pressure-fluid controlled systems, say for extension of roof-bars behind the mining machine prior to push and pull advance of the conveyor and roof supports and subsequent retraction thereof, or may be directly controlled by program subroutines. This may be particularly the case in a shortwall mining system where partial advances of the roof supports and extension and retraction of roof-bars are provided for. Other types of operation have been referred to hereinbefore, say where a mining machine needs more than one traverse of the face to cut the full height and/or cutting takes place in either or both directions of mining machine traverse. Clearly bank or single chock control, or a mixture thereof, could be applied to various phases of such systems with or without provision for partial advancing.

Figure 4:
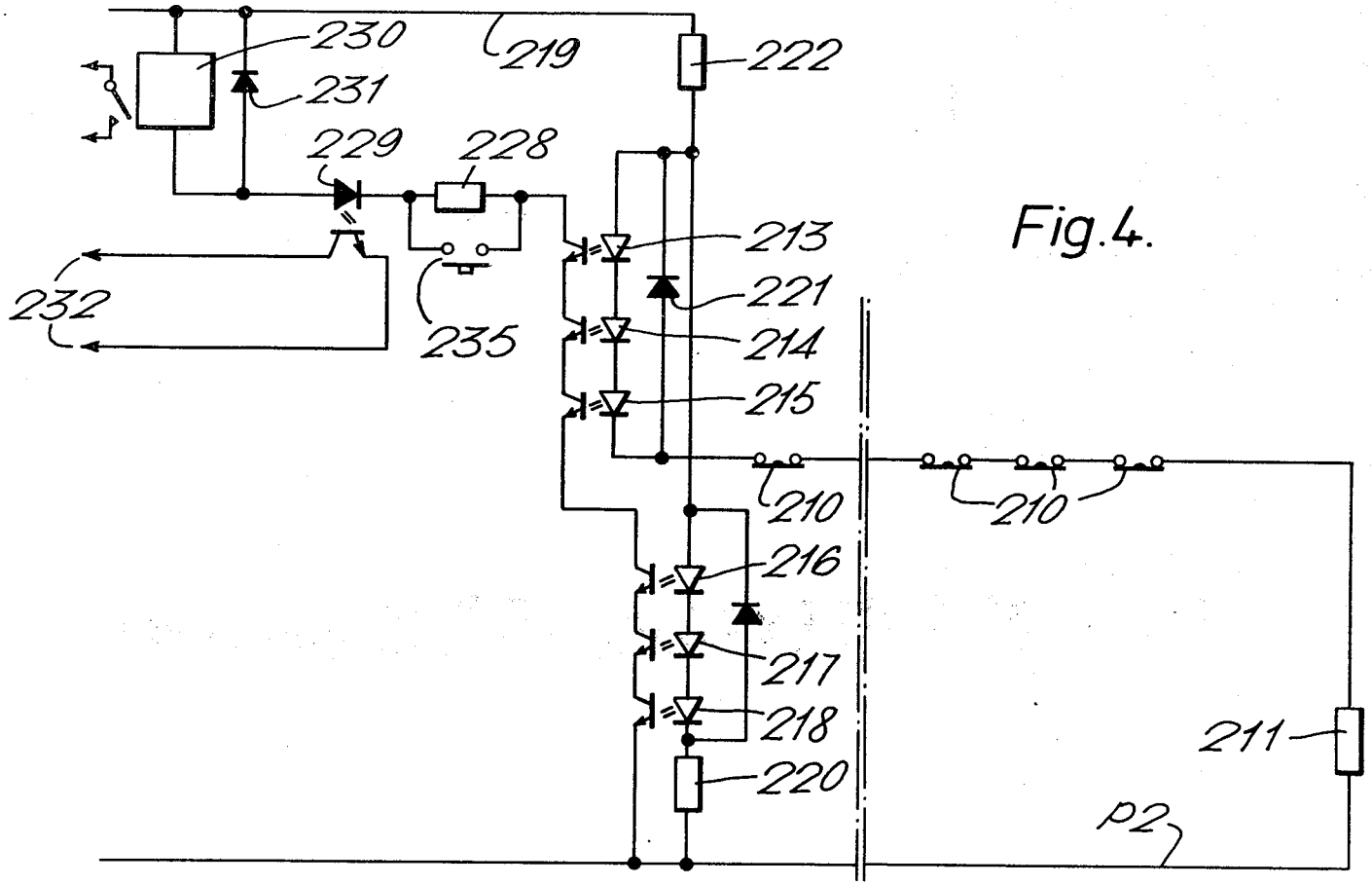
FIG. 4 is a circuit diagram of a preferred emergency stop facility.

A preferred emergency stop facility is shown in the circuit diagram of FIG. 4, which shows normally closed button-operated switches 210 at the control unit and at each chock.

These switches 210, except when operated, make the emergency stop line continuous between a termination resistor 211 to ground line P1 and, via light sources of electro-optic isolators 213 to 215 paralleled by a protection diode 221, and a feed resistor 222 to a nominal 12-volt line 219. The feed resistor 222 is also connected via light sources of electro-optic isolators 216 to 218 and resistor 220 to ground line P1. The other, switching sides, shown as phototransistors, of all the electro-optic isolators 216 to 218 are connected together in series between the ground line P1 and a control resistor 228 itself connected via the light source of another electro-optic isolator 229 and a hold circuit of a relay 230 to the 12-volt line. The relay 230 has a normally open volt-free contact for control output purposes and is bridged by a protection diode 231. The further isolator 229 is shown as providing an output 232 to the remote control unit processor.

The relay 230 will only be held in, i.e. operated to its closed contact state, if all of the electro-optic isolators 213 to 218 are energised. This will occur only if the emergency stop line is continuous, i.e. not when an emergency stop button 210 is operated to de-energise isolators 213 to 215 which will extinguish if subjected to 12-volts from line 219, and if the emergency stop line is not shorted to earth, which will extinguish the isolators 216 to 218. The number of isolators 213 to 215 and 216 to 218 used is, of course, related only to their characteristics relative to the 12-volt supply.

Clearly, the relay 230 will drop out as soon as one or more of the isolators 213 to 218 extinguish, and the value of resistor 230 is such that, although it will maintain the relay 230 in until an isolator extinguishes, it will not allow the relay to close again simply by re-energising all of the isolators 213 to 218. Instead, a reset button switch 235 must be operated to short across the control resistor. Thus, once an emergency stop button has been operated, the reset button 235 must be operated to restart. However, the reset button 235 has no effect if one or more of the isolators is extinguished.

It is convenient to take an output from the relay as shown at 240 for control purposes. The overall circuit satisfies intrinsic safety requirements for coal mines.

We claim:

1. A control system for a plurality of self-advancing mine roof supports, the system comprising units, one at each of the supports, and each having means for receiving function initiating signals from a communication system common to the supports, means responsive to those function initiating signals for issuing corresponding control signals to component elements of the associated support and means for transmitting data to the communication system; and a remote control unit for issuing control signals including such function initiating signals over the communication system and for receiving data from the supports, the remote control unit including means for specifying a sequential or automatic mode wherein support advancing means are successively operated sequentially relative to a preset distance, means for specifying selective or manual modes wherein an individual support is selected and controlled without reference to any set sequence, one such selective or manual mode implementing the operation of the support advancing means to a, or said preset distance, and another allowing such operation without preset of its distance, and means for displaying data from and relating to the supports.

2. A control system according to claim 1, wherein each support unit includes means for producing data representing its support advance relative to a prescribed condition of advancing ram means of the associated support.

3. A control system according to claim 2, wherein said prescribed condition is an extension of said advancing ram means.

4. A control system according to claim 2, wherein said prescribed condition is retraction of said advancing ram means.

5. A control system according to claim 1, wherein each support unit includes latchable means operative in said one but not said other selective or manual mode to control pressurisation of the advancing ram means until a preset advance is achieved.

6. A control system according to claim 5, wherein the latchable means comprises or controls a solenoid valve.

7. A control system for a plurality of self-advancing mine roof supports, the system comprising units, one at each of the supports, and each having means for receiving function initiating signals from a communication system common to the supports, means responsive to those function initiating signals for issuing corresponding control signals to component elements of the associated support and means for transmitting data to the communication system; and a remote control unit for issuing control signals including such function initiating signals over the communication system and for receiving data from the supports, the remote control unit including means for specifying a sequential or automatic mode wherein support advancing means are successively operated sequentially, means for specifying and controlling a further mode of automatic operation wherein the support units are sequentially addressed and caused only to transmit data concerning their states, and means for displaying data from and relating to the supports.

8. A control system according to claim 7, wherein the remote control unit automatically institutes said further mode of automatic operation before each of its first mentioned automatic modes is started.

9. A control system according to claim 7, wherein the remote control unit further comprises means operative during said further mode of automatic operation to compare incoming data with presets and halt that mode on detecting a discrepancy.

10. A control system according to claim 9, wherein the remote control unit includes means for restarting the further mode after correction of said discrepancy in a selective or manual mode.

11. A control system according to claim 10, wherein the means for restarting serves to resume the further automatic mode at the stage at which it halted.

12. A control system according to claim 7, wherein the remote control unit includes means for cumulating, storing, and displaying data relating to successive actual advances of each of the supports.

13. A control system according to claim 7, wherein the remote control unit is further connected to receive input signals representing the position of a mining machine and has means responsive thereto to control support unit addressing for support advance so that a minimum headway of the mining machine is maintained.

14. A control system according to claim 7, wherein the remote control unit includes a programmed, word-organised, parallel-operating electronic computer.

15. A control system according to claim 14, wherein each support unit is an electronic unit uniquely addressable by the remote control unit and includes means for translating multibit binary instructions into specific enabling signals.

16. A control system according to claim 15, wherein the remote control unit has parallel-to-serial binary digit converting means interfacing it to said communication system, and each support unit has serial-to-parallel digit conversion means interfacing it to said communication system.

17. A control system according to claim 16, further comprising means for parity checking multi-bit binary words.

18. A control system according to claim 16, wherein the communication system includes separate cores or lines for different directions of transmission between the remote control unit and the support units.

19. A control system according to claim 16, wherein the transmission system includes a multi-core or-line common interconnection of the support units and the remote unit, each core or line having a specified and distinct purpose.

20. A control system according to claim 19, wherein the remote control unit includes power supply means for the entire control system and two conductor cores or lines on the interconnection are reserved for the supply of appropriate operating voltage levels for the electronics of the support units.

21. A control system according to claim 19, wherein the power supply means has a first power supply for the remote control unit and a second power supply for the support units.

22. A control system according to claim 20, wherein the power supply means includes a back-up battery chargeable from active power supply means thereof in order to maintain information in a volatile semiconductor type store of the remote control unit for a desired minimum period of time following malfunction of said active power supply means.

23. A control system according to claim 19, wherein one said core or line is reserved for clock signals from the remote control unit to the support units.

24. A control system according to claim 19, wherein at least some of the control units have audible indicators and a said core or line is reserved for transmission of audio signals thereto by means operative immediately preceding and/or during operation of that support.

25. A control system according to claim 19, wherein the remote control unit and support units are equipped for voice communication via a said core or line.

26. A control system according to claim 19, wherein each said support unit has an emergency stop means operative over a said one core or line to cause the remote control unit to operate means for stopping all support operations.

27. A control system according to claim 26, wherein the emergency stop core or line traverses at least selected support units via a circuit interruptible by means at each such support unit, and the remote control unit includes control circuit means responsive to such circuit interruption.

28. A control system according to claim 28, wherein the remote control unit also includes means for interrupting the emergency stop core or line circuit.

29. A control system for a plurality of self-advancing mine roof supports, the system comprising electronic uniquely addressable units, one at each of the supports, and each having serial-to-parallel binary digit converting means for receiving multi-bit digital function initiating signals from a serial binary digit communication system common to the supports, means for translating those function initiating signals into specific enabling signals for component elements of the associated support and means for transmitting data to the communication system; a remote control unit for issuing control signals including such function initiating signals over the communication system and for receiving data from the supports, the remote control unit comprising a programmed, word-organized, parallel-operating computer affording means for specifying a squestional or automatic mode wherein support advancing means are successively operated sequentially, relative to a preset distance and means for specifying selective or manual modes wherein an individual support is selected and controlled without reference to any set sequence, one such selective or manual mode implementing the operation of the support advancing means to a, or said preset distance, and another allowing such operation without preset of its distance, parallel-to-serial binary digit converting means inferfacing to said communication system, and means for displaying data from and relating to the supports, the communication system comprising a multi-line interconnection of the support units and the remote unit, each line having a specified and distince purpose with one such line traversing at least selected support units via a circuit interruptable by means at each such support unit the remote control unit having control circuit means responsive to such circuit interruption and other circuit means to detect short-circuiting of the emergency stop line circuit.

30. A control system according to claim 29, wherein the first-mentioned and other control circuit means are connected in series and in parallel, respectively, to the emergency stop core or line.

31. A control system according to claim 30, wherein the first-mentioned and other control circuit means serve to energise detector means connected in series in a control path of a control circuit common thereto.

32. A control system according to claim 31, wherein the first-mentioned and other control circuit means comprises light source sides of electro-optic isolators of which switching device sides constitute the detector means.

33. A control system according to claim 32, wherein the detector means comprise photo-transistors.

34. A control system according to claim 31, wherein the control path is of a monostable device.

35. A control system according to claim 34, wherein the monostable device is a relay having normally open contacts, preferably volt-free, and a hold via said control path.

36. A control system according to claim 34, wherein the control path includes shortable regulator means to ensure maintenance of the non-rest state of the monostable device except when the control path is interrupted but not to reset to that state unless shorted.

37. A control system for a plurality of self-advancing mine roof supports, the system comprising, units one at each of the supports, and each having means for receiving function initiating signals from a communication system common to the supports, means responsive to those function initiating signals for issuing corresponding control signals to component elements of the associated support and means for transmitting data to the communication system; and a remote control unit for issuing control signals including such function initiating signals over the communication system and for receiving data from the supports, the remote control unit including means for specifying a sequential or automatic mode wherein support advancing means are successively operated sequentially, relative to a preset distance, means for specifying and controlling a further mode of automatic operation wherein the support units are sequentially addressed and caused only to transmit data concerning their states, means for specifying selective or manual modes wherein an individual support is selected and controlled without reference to any set sequence, one such selective or manual mode implementing the operation of the support advancing means to a, or said preset distance, and another allowing such operation without preset of its distance, and means for displaying data from and relating to the supports.

* * * * *